United States Patent [19]

Williams

[11] Patent Number: 4,969,277

[45] Date of Patent: Nov. 13, 1990

[54] ADJUSTABLE SHOE

[76] Inventor: Paul H. Williams, 1920 Kirby Pky., Germantown, Tenn. 38138

[21] Appl. No.: 935,962

[22] Filed: Nov. 28, 1986

[51] Int. Cl.[5] ..... A43B 3/26; A43B 23/00

[52] U.S. Cl. ..... 36/97; 36/50; 36/105

[58] Field of Search ..... 36/97, 88, 92, 95, 110, 36/105, 50, 45, 51; 2/DIG. 6

[56] References Cited

U.S. PATENT DOCUMENTS

| | | | |
|---|---|---|---|
| 1,960,165 | 5/1934 | Ottinger | 36/50 |
| 2,603,889 | 7/1952 | Lahnstein et al. | 36/50 |
| 3,142,911 | 8/1964 | Waters | 36/97 |
| 3,618,235 | 11/1971 | Cary, Jr. | 36/97 |
| 4,136,468 | 1/1979 | Munschy | 36/97 |
| 4,178,703 | 12/1979 | Pols | 36/105 |
| 4,215,493 | 8/1980 | Antonious | 36/51 |
| 4,451,995 | 6/1984 | Antonious | 36/51 |
| 4,547,982 | 10/1985 | Gamm | 36/50 |
| 4,599,811 | 7/1986 | Rousseau | 36/97 |

FOREIGN PATENT DOCUMENTS

| | | | |
|---|---|---|---|
| 81/01948 | 7/1981 | PCT Int'l Appl. | 36/97 |
| 2048646 | 12/1980 | United Kingdom | 36/50 |

*Primary Examiner*—Steven N. Meyers

*Attorney, Agent, or Firm*—Walker and McKenzie

[57] ABSTRACT

An adjustable shoe to properly fit a wear's heel, midfoot, forefoot and toes. The lower edges of first and second body members are securely attached to the first and second side edges, respectively, of a sole member from a point conterminous with the midline of the toe end of the sole member to points on the first and second side edges, respectively, of the sole member spaced from the midline of the heel end of the sole. A first attachment structure adjustably secures the heel end portions of the body members relative to one another. A second attachment structure adjustably secures the forefoot portions of the body members relative to one another.

3 Claims, 6 Drawing Sheets

ADJUSTABLE SHOE

BACKGROUND OF THE INVENTION

1. Field of the Invention:

The present invention relates to a shoe adjustable to properly fit a wearer's heel, midfoot, forefoot and toes.

2. Description of the Related Art:

A preliminary patentability search in class 36, subclasses 95, 97 and 105 resulted in the following patents: Gunn, U.S. Pat. No. 641,642; Ludwig, U.S. Pat. No. 2,391,720; Spencer, U.S. Pat. No. 2,591,211; Seurbom, U.S. Pat. No. 2,734,284; Schneider et al, U.S. Pat. No. 2,745,196; Voss, U.S. Pat. No. 2,780,013; Rigsby, U.S. Pat. No. 3,057,085 and 3,057,086; Rigsby, U.S. Pat. No. 3,058,241; Smith, U.S. Pat. No. 3,192,651; Cary, U.S. Pat. No. 3,618,235; Colby, U.S. Pat. No. 4,120,103; and Munschy, U.S. Pat. No. 4,136,468. None of the above patents disclose or suggest the present invention.

SUMMARY OF THE INVENTION

The present invention is directed toward providing an all weather shoe designed to adjust to problems that occur in the heel, midfoot, forefoot and toes. The adjustable shoe comprises, in general, a sole member including a toe end and a heel end and having a first side edge extending from the midline of the toe end to the midline of the heel end and a second side edge extending from the midline of the toe end to the midline of the heel end; a first body member having a lower edge securely attached to the first side edge of the sole member from a front attachment point to a rear attachment point adjacent the midline of the heel end of the sole member; a second body member having a lower edge securely attached to the second side edge of the sole member from a front attachment point to a rear attachment point adjacent the midline of the heel end of the sole member; first attachment means for adjustably securing the heel end portions of the body members relative to one another and for allowing the shoe to be adjusted for different heel shapes and sizes; and second attachment means for adjustably securing the forefoot portions of the body members relative to one another and for allowing the shoe to be adjusted for different midfoot, forefoot and toe shape and size.

BRIEF DESCRIPTION OF THE PREFERRED EMBODIMENT

Figure 1:
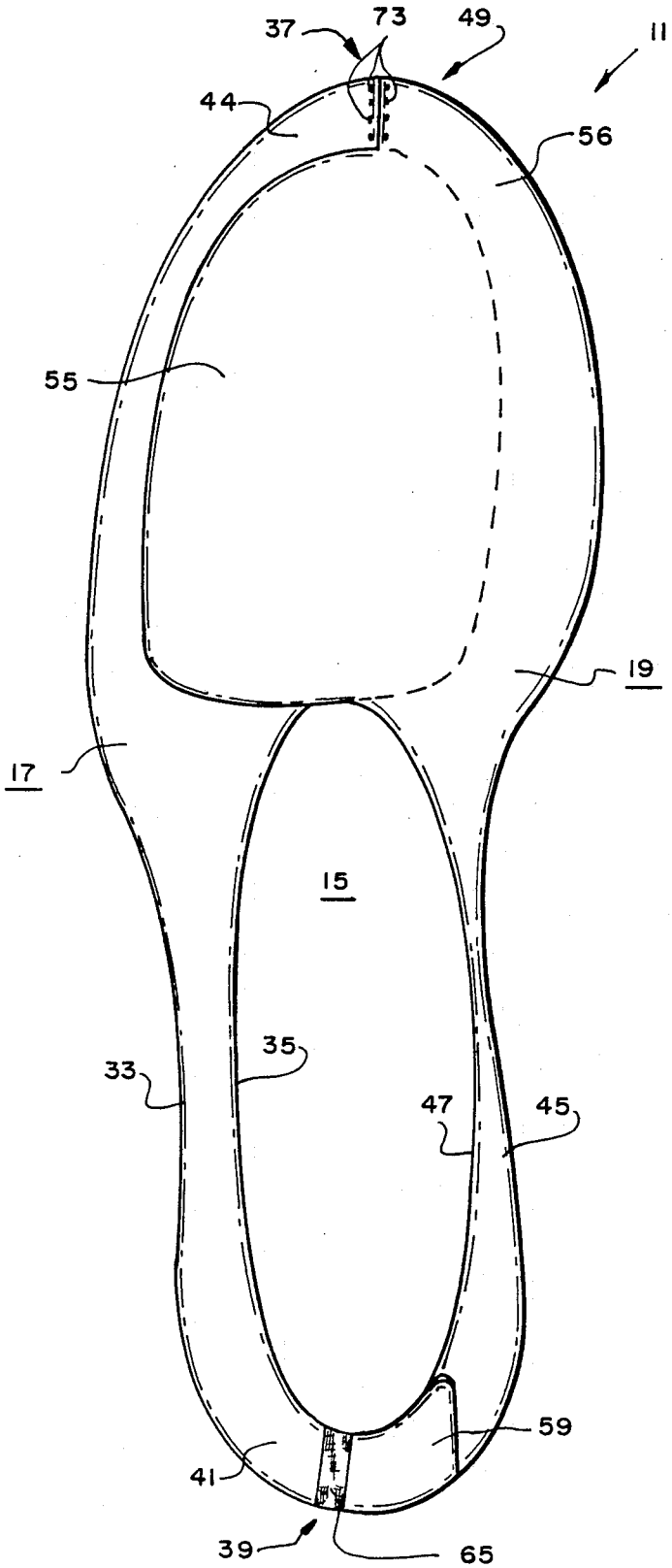
FIG. 1 is a top plan view of the orthopedic shoe of the present invention.
Figure 2:
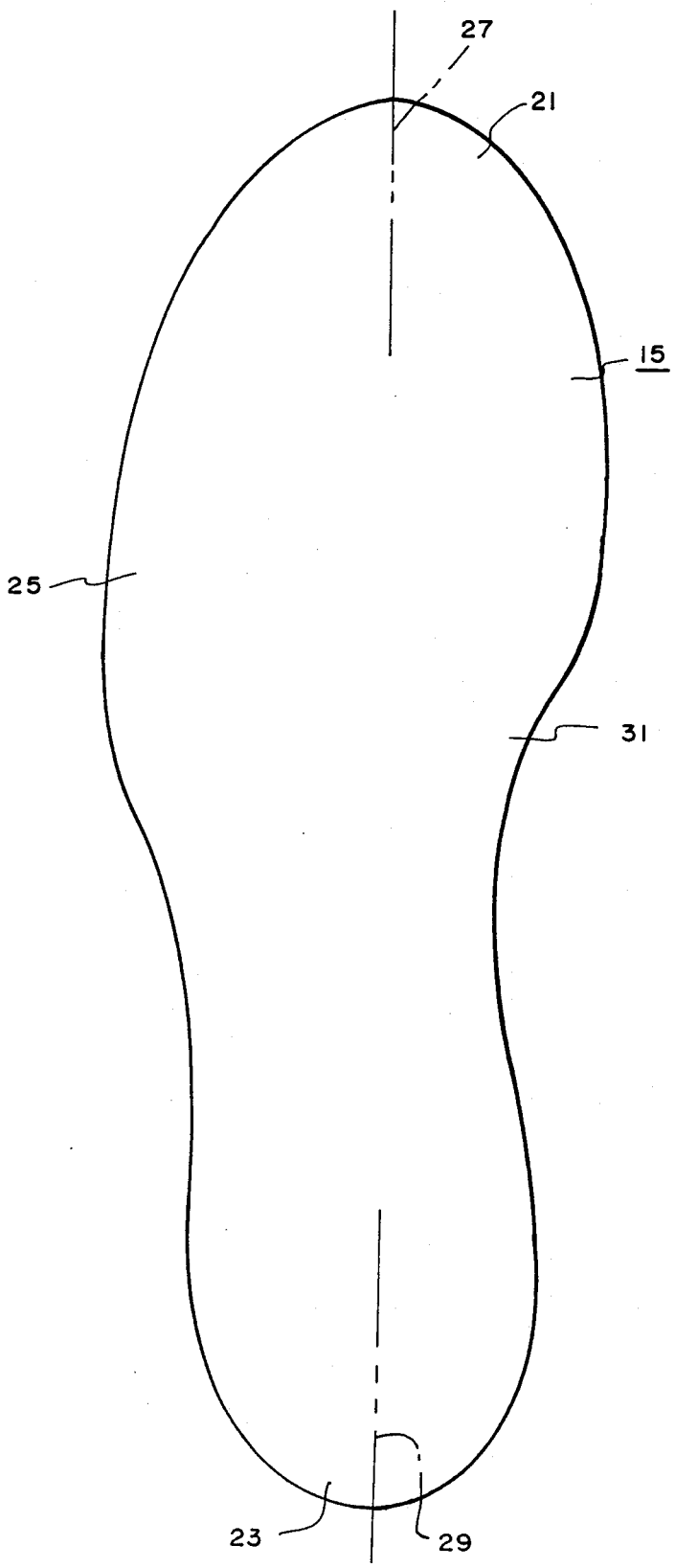
FIG. 2 is a top plan view of the sole member of the shoe of FIG. 1.
Figure 3:
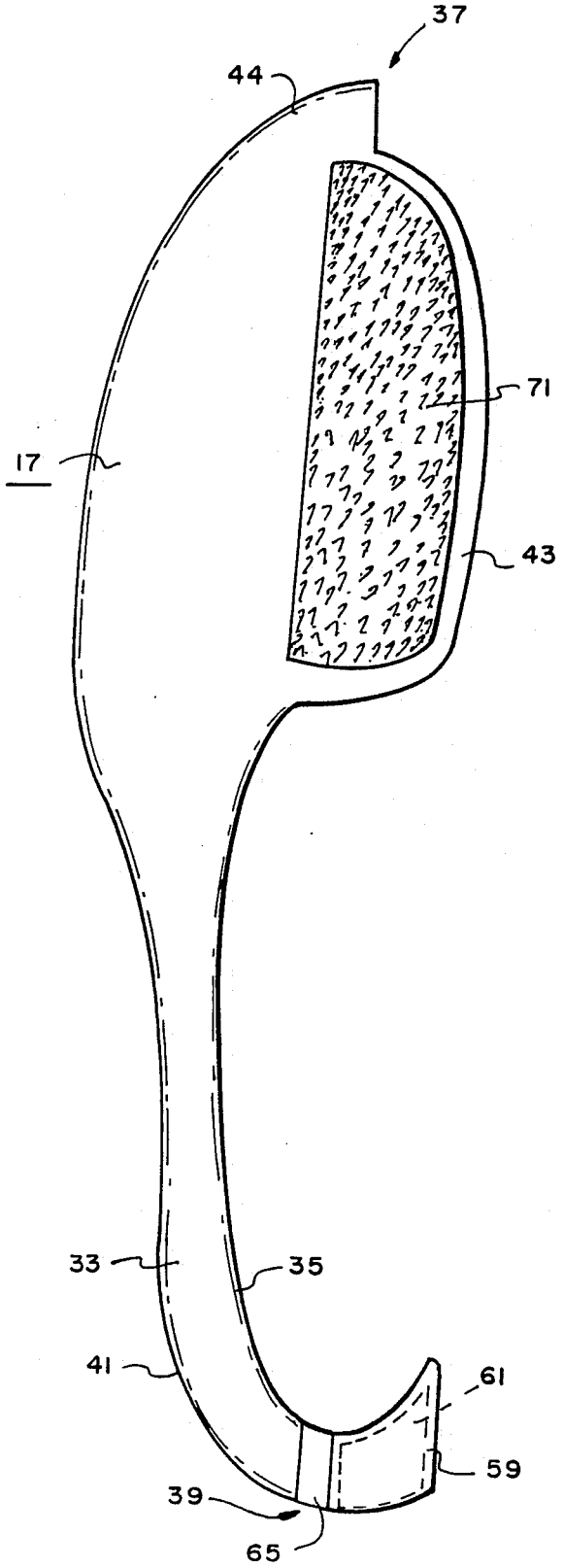
FIG. 3 is a top plan view of the first or lateral body member of the shoe of FIG. 1.
Figure 4:
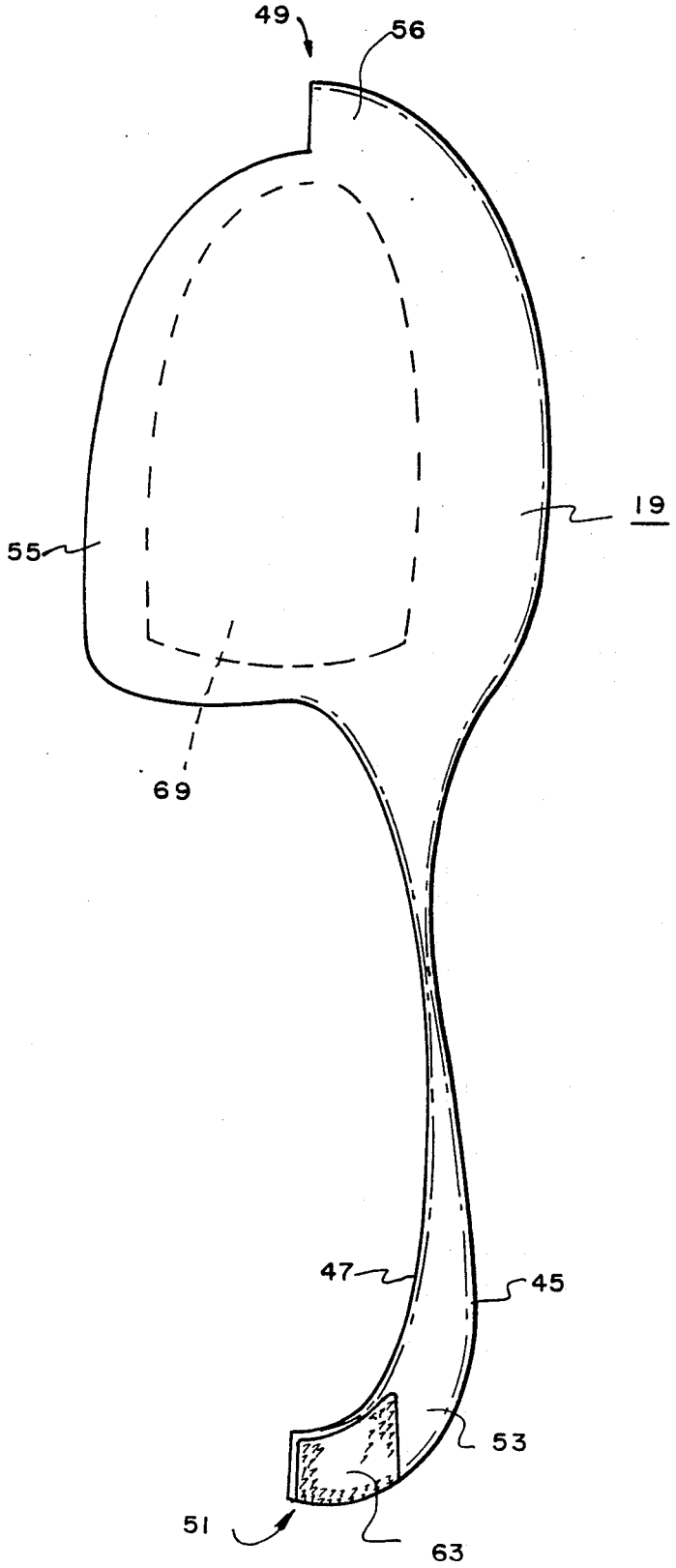
FIG. 4 is a top plan view of the second or medial body member of the shoe of FIG. 1.

The preferred embodiment of the present invention provides an adjustable shoe 11 that is adjustable to properly fit the heel, midfoot, forefoot and toes of a person's foot 13 (see, in general, FIGS. 6–9). The shoe 11 comprises, in general, the combination of a sole member 15 (see FIG. 2), a first or lateral body member 17 (see FIG. 3) substantially forming one-half of the upper portion of the shoe 11, and a second or medial body member 19 (see FIG. 4) substantially forming the other one-half of the upper portion of the shoe 11.

The sole member 15 includes a front or toe end 21 and a rear or heel end 23 and has a first or lateral side edge 25 extending from the midline 27 of the toe end 21 to the midline 29 of the heel end 23 and has a second or medial side edge 31 extending from the midline 27 of the toe end 21 to the midline 29 of the heel end 23. The specific construction, shape and size of the sole member 15 may vary as will now be apparent to those skilled in the art. Thus, the sole member 15 may be constructed out of leather, rubber or the like in any manner now apparent to those skilled in the art in various shapes and sizes now apparent to those skilled in the art.

The first body member 17 has a lower edge 33 and an upper edge 35. The lower edge 33 of the first body member 17 is securely attached relative to the first side edge 25 of the sole member 15 from a front attachment point 37 preferably at the midline 27 of the toe end 21 of the sole member 15 to a rear attachment point 39 adjacent the midline 29 of the heel end 23 of the sole member 15. The rear attachment point 39 is preferably on the first side edge 25 of the sole member 15 spaced from the midline 29 of the heel end 23 of the sole member 15. The first body member 17 has a rear or heel end portion 41 for coacting with and preferably covering at least a portion of the heel of the user's foot 13, has a flap-like forefoot portion 43 for covering at least a portion of the forefoot of the user's foot 13, and has a front or top end portion 44. The specific construction, shape and size of the first body member 17 may vary as will now be apparent to those skilled in the art. Thus, for example, the first body member 17 may be constructed out of a single piece of substantially flexible leather or the like and the lower edge 33 thereof may be securely stitched to the first side 25 of the sole member 15, etc.

The second body member 19 has a lower edge 45 and an upper edge 47. The lower edge 45 of the second body member 19 is securely attached to the second side edge 31 of the sole member 15 from a front attachment point 49 preferably at the midline 27 of the toe end 21 of the sole member 15 to a rear attachment point 51 adjacent the midline 29 of the heel end 23 of the sole member 15. The rear attachment point 51 is preferably on the second side edge 31 of the sole member 15 spaced from the midline 29 of the heel end 23 of the sole member 15. The second body member 19 has a rear or heel end portion 53 for coacting with and preferably covering at least a portion of the heel of the user's foot 13, has a flap-like forefoot portion 55 for covering at least a portion of the forefoot of the user's foot 13, and has a front or toe end portion 56. The specific construction, shape and size of the second body member 19 may vary as will now be apparent to those skilled in the art. Thus, for example, the second body member 19 may be constructed from a single piece of substantially flexible leather or the like with the lower edge 45 thereof securely stitched to the second side 31 of the sole member 15.

Figure 5:
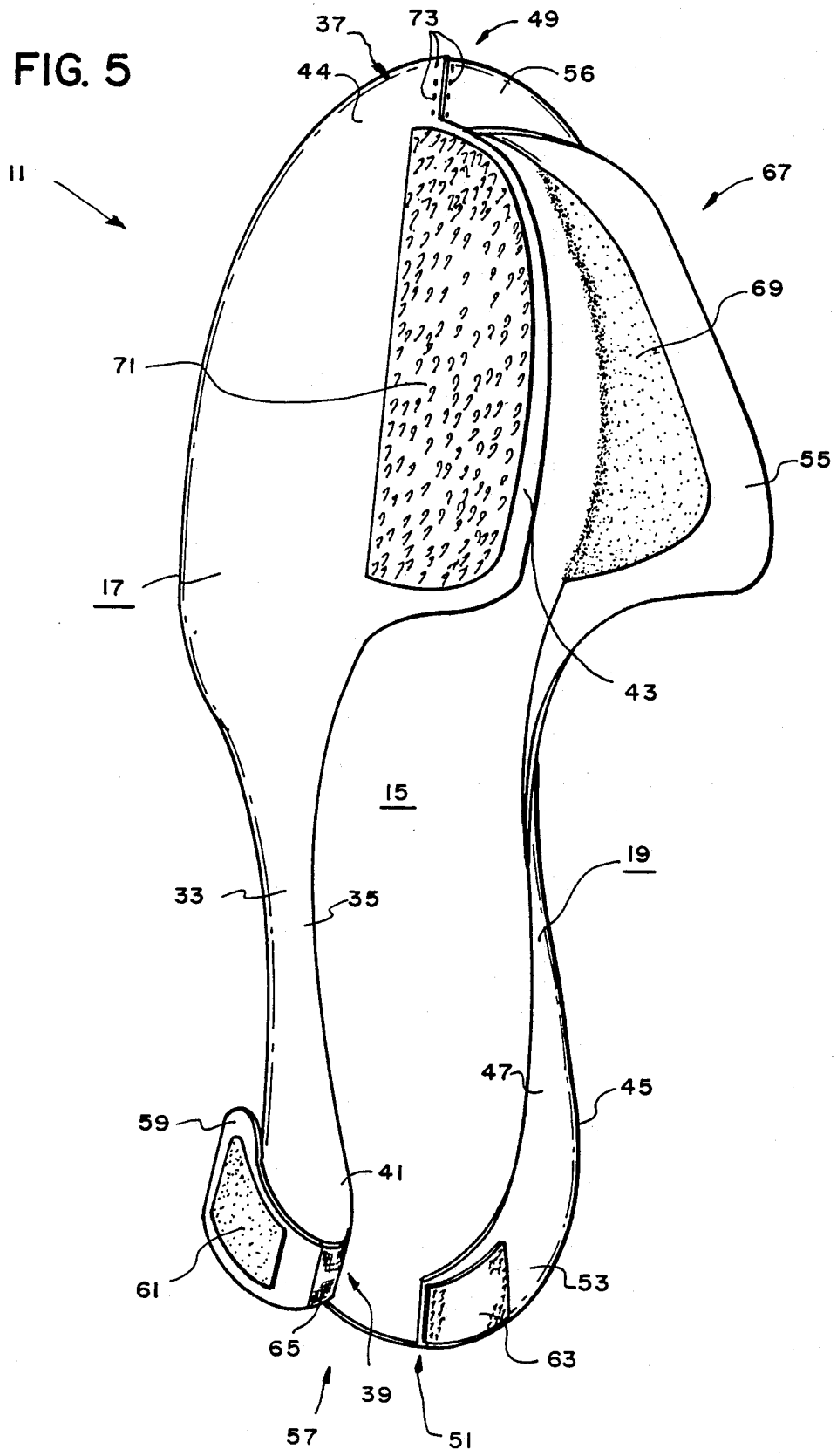
FIG. 5 is a top plan view of the shoe of FIG. 1 showing the first and second attachment means in an open position.
Figure 6:
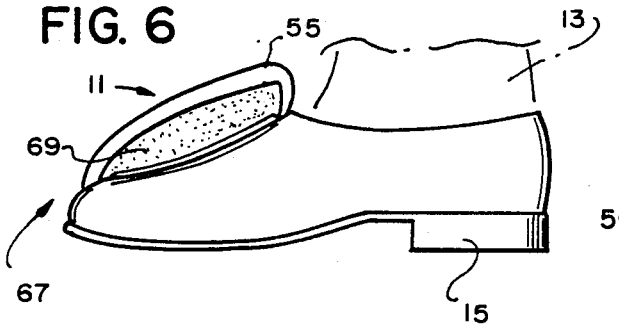
FIG. 6 is a side elevational view of the shoe of FIG. 1 showing the second attachment means in an open position.
Figure 7:
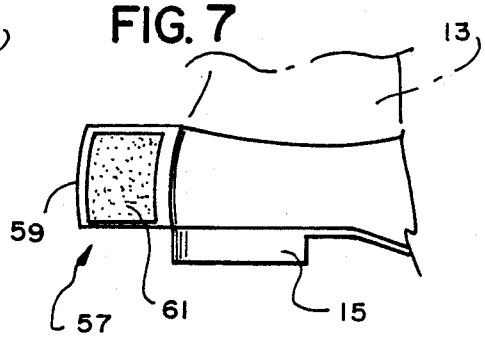
FIG. 7 is a side elevational view of a portion of the shoe of FIG. 1 showing the first attachment means in an open position.
Figure 8:
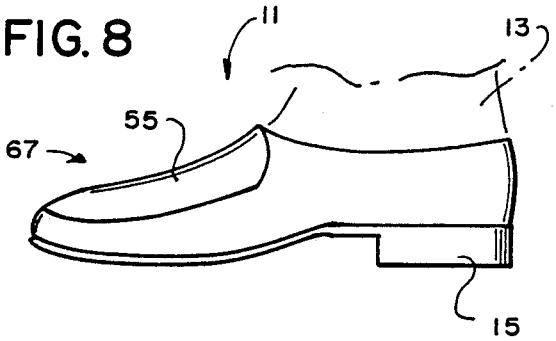
FIG. 8 is a side elevational view of the shoe of FIG. 1 showing the second attachment means in a closed position.
Figure 9:
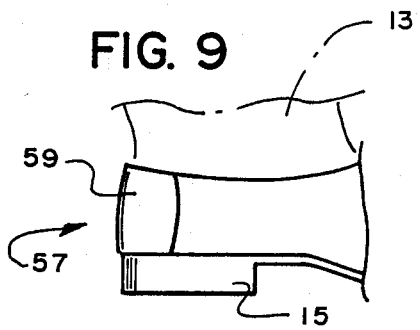
FIG. 9 is a side elevational view of a portion of the shoe of FIG. 1 showing the first attachment means in a closed position.
Figure 10:
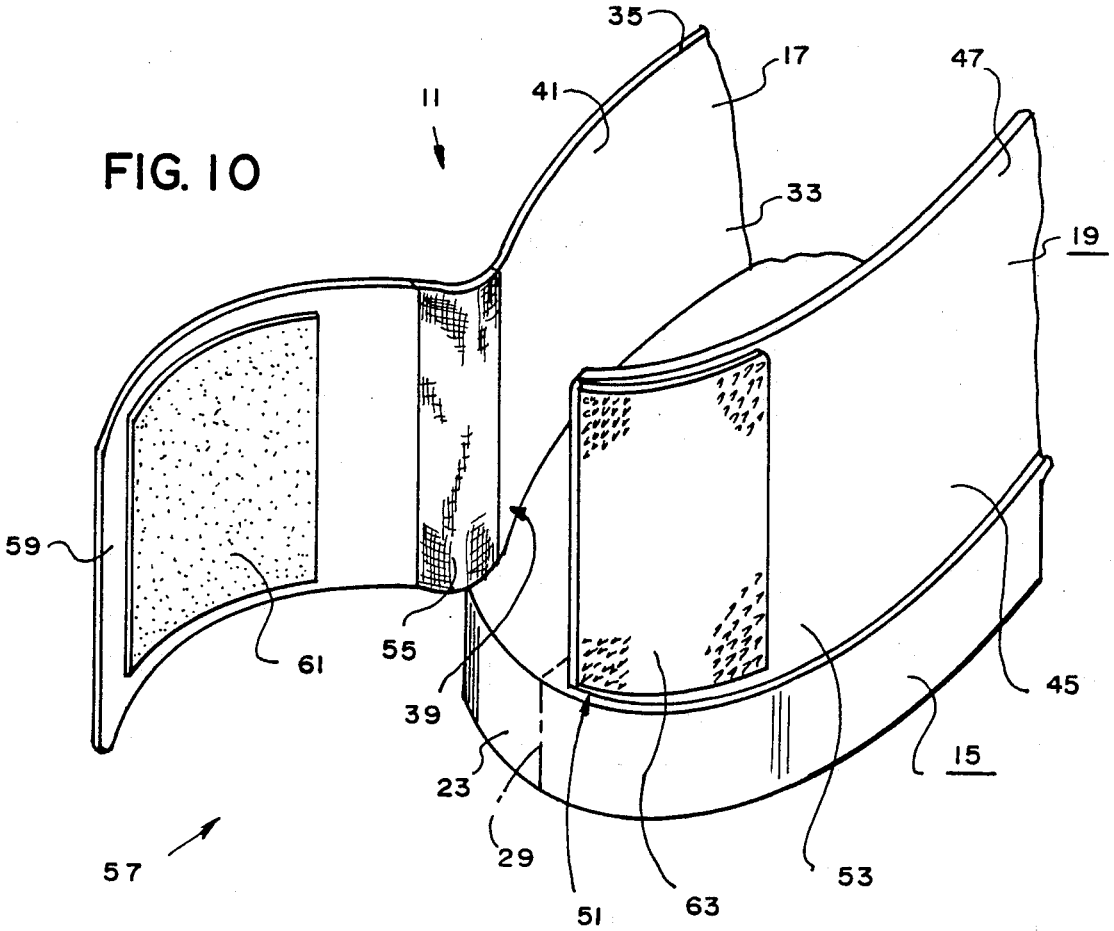
FIG. 10 is a perspective view of the rear portion of the shoe of FIG. 1 showing the first attachment means in an open position.

The shoe 11 includes a first attachment means 57 (see, in general, FIG. 5) for adjustably securing the heel end portions 41, 53 of the body members 17, 19 relative to one another and for allowing the shoe 11 to be adjusted for different heel shapes and sizes. The first body member 17 preferably includes a heel flap member 59 attached to the heel end portion 41 thereof for extending from the rear attachment point 39 thereof to the heel end portion 53 of the second body member 19. The first attachment means 57 may include Velcro-type fastening means typically having a pile portion 61 and a hook portion 63 for allowing varied adjustment of the heel end portions 41, 53 of the body members 17, 19 relative to one another as will now be apparent to those skilled in the art. The pile portion 61 may be secured to the inner face of the heel flap member 59 and the hook portion 63 may be secured to the outer face of the heel end portion 53 in any manner now apparent to those skilled in the art such as by being stitched thereto.

The first body member 17 may include elastic means 65 attaching the heel flap member 59 to the heel end portion 41 thereof for allowing relative movement therebetween.

The shoe 11 includes a second attachment means 67 (see, in general, FIG. 5) for adjustably securing the forefoot portions 43, 55 of the body members 17, 19 relative to one another and for allowing the shoe 11 to be adjusted for different midfoot, forefoot and toe shapes and sizes. The second attachment means 67 may include Velcro-type fastening means typically having a pile portion 69 and a hook portion 71 for allowing varied adjustment of the forefoot portions 43, 55 of the body members 17, 19 relative to one another as will now be apparent to those skilled in the art. The pile portion 69 may be secured to the forefoot portion 55 of the second body member 19 and the hook portion 71 may be secured to the forefoot portion 43 of the first body member 17 in any manner now apparent to those skilled in the art such as by being stitched thereto.

The front or toe end portions 44, 56 of each body member 17, 19 are preferably fixedly secured to one another by stitches 73 or the like.

To use the shoe 11 of the present invention, the user's foot 13 is merely inserted into the shoe with the first and second attachment means 57, 67 loosened. To then properly adjust the shoe 11 to the specific shape and size of the user's foot 13, the heel flap member 59 is merely pulled over the heel end portion 53 of the second body member 19 and the first attachment means 57 engaged to thereby secure the heel flap member 59 to the heel end portion 53, and the forefoot portion 55 of the second body member 19 is merely pulled over the forefoot portion 43 of the first body member 17 and the second attachment means 67 is engaged to thereby secure the forefoot portions 43, 55 to one another. The combination of elements of the present invention allows the shoe 11 to be adjusted for different heel, midfoot, forefoot and toe shape and size.

The present invention provides an all weather shoe designed to adjust to problems that occur in the heel, midfoot, forefoot, and toes. The heel will adjust to increased and decreased widths. Midfoot problems can be addressed by adjusting the medial and lateral flaps with Velcro attachments which extend up over the forefoot. Forefoot and toe problems can also be relieved of pressure complaints by adjusting the medial and lateral flaps with Velcro attachments which extend over the forefoot and toes. The design of the shoe will also permit adjustment of the shoe for increased vertical height in the toe cap for such problems as claw toes and hammer toes.

I became interested in developing a shoe of this type 10 years ago because of foot problems which I have observed while working as an orthopedic surgeon. I have observed that many people walk on the back portions of the heels of the shoe as opposed to having the heel down inside the shoe. I have also observed that many people buy new shoes and immediately make various holes in the shoes with razor blades to accommodate their feet. I have observed many people that have a heel that is much wider than people of the same body height, weight and size. In addition to having a wide heel, in many instances, a rim of soft tissue extends out from the plantar surface of the heel medially, laterally and posteriorly. This makes an already wide heel much wider. The midfoot of these same people is also substantially wider. Many people also have flat feet with essentially no bony arch and with substantial fibrofatty pads over the plantar aspect of the foot which is thicker than the pad in other people. The forefoot in these same people is somewhat wider generally but the discrepancy is not nearly as great as in the heel and midfoot.

I have examined many athletes in my professional career because my practice has been tilted towards sports medicine. A few years ago, I examined all 15 players on the state championship basketball team of a local major classification high school. Twelve of the 15 athletes had wide heels, wide midfeet and flat feet. Three of these athletes had what I believe to be a normal arch, based on what I had been trained to know as an orthopedic surgeon. Two of the three players were the worst players on the team and the other player, a senior, was a fair player but he was not a leaper. All of the leapers were flat footed, with wide heels and wide midfeet. Therefore, I conclude that these feet are not abnormal. However, obtaining proper foot wear is extremely difficult because of the configuration of these feet.

My opinion is that 90 percent of the foot problems that I see in women are brought on by improper foot wear. Adjustable shoes would permit these same women to wear approximately the same shoe size with the adjustable feature of the shoes leading to marked benefits and increased foot comfort. Women, like men, must wear the shoes that are available. There is no reason, as far as I'm concerned, that the adjustable shoe design, which I propose, could not be used for very stylish shoes. The shoe design which I propose could be used on high heels, mid heel shoes, low heel shoes and no heel shoes. The shoe design could also be used for various sports shoes such as jogging shoes, tennis shoes, golf shoes, etc.

My belief is that these adjustable shoes could substantially decrease the discomfort caused by hallux valgus with bunions, Mortons neuromas, claw toes, hammer toes, bunionettes, soft corns, callouses, etc., which are brought on by improper fitting shoes. These shoes could also relieve complaints in the midfoot such as bony prominances over the first tarso-metarsal joint and peroneal tendinitis over the fifth metatarsal base area. The heel adjustments in this shoe could be markedly beneficial in "pump bumps" which are seen on the posterior aspect of the os calcis, following fractures, and in achilles tendinitis. Adjustable shoes would also be markedly beneficial in people who have swelling of their feet when they are upright, such as women with premenstral fluid retention, people with congestive heart failure, kidney problems which cause the feet to swell, and other fluid retention problems. The shoe design would also be beneficial in post traumatic circumstances whereby a person sustains a foot, ankle or tibial injury with unilateral swelling (one foot only) following trauma, for several weeks or months. The shoe could be adjusted outward to accommodate for the swelling.

My aim and goal is to decrease the amount of surgery performed on peoples feet for the problems mentioned hereabove. Many of the foot operations performed by orthopedic surgeons and podiatrists could be eliminated if proper foot wear was available to relieve the pressure from the various entities mentioned with a result in the relief of pain. Most of the people who have foot operations are relatively comfortable when they don't have on shoes. Financial savings for Medicare, Medicaid and the insurance industry, in general, would be substantial if the amount of foot surgery is substantially reduced.

Although the present invention has been described and illustrated with respect to a preferred embodiment thereof and a preferred use therefore, it is not to be so limited since changes and modifications can be made therein which are within the full intended scope of the invention.

I claim:

1. A dress shoe adjustable to properly fit a wearer's heel, midfoot, forefoot and toes with only a typical sock covering the wearer's heel, midfoot, forefoot and toes, said shoe comprising, in combination:

(a) a sole member including a toe end and a heel end and having a first side edge extending from the midline of said toe end to the midline of said heel end and a second side edge extending from the midline of said toe end to the midline of said heel end;

(b) a first body member having a lower edge securely attached relative to said first side edge of said sole member from a front attachment point to a rear attachment point adjacent said midline of said heel end of said sole member, said first body member having a heel end portion for coacting with at least a portion of the wearer's heel with only a typical sock covering the wearer's heel and having a forefoot portion for coacting with at least a portion of the wearer's forefoot with only a typical sock covering the wearer's forefoot;

(c) a second body member having a lower edge securely attached relative to said second side edge of said sole member from a front attachment point to a rear attachment point adjacent said midline of said heel end of said sole member, said second body member having a heel end portion for coacting with at least a portion of the wearer's heel with only a typical sock covering the wearer's heel and having a forefoot portion for coacting with at least a portion of the wearer's forefoot with only a typical sock covering the wearer's forefoot;

(d) first attachment means for adjustably securing said heel end portions of said body members relative to one another and for allowing said shoe to be adjusted for different heel shape and size and for applying pressure to the wearer's heel; and (e) second attachment means for adjustably securing said forefoot portions of said body members relative to one another and for allowing said shoe to be adjusted for different midfoot, forefoot and toe shape and size and for applying pressure to the wearer's midfoot, said first body member including a heel flap member attached to said heel end portion thereof for extending from said rear attachment point thereof to said heel end portion of said second body member.

2. The shoe of claim 1 in which said first body member includes elastic means attaching said heel flap member to said heel end portion thereof for allowing relative movement therebetween.

3. A dress shoe adjustable to properly fit a wearer's heel, midfoot, forefoot and toes with only a typical sock covering the wearer's heel, midfoot, forefoot and toes, said shoe comprising, in combination:

(a) a sole member including a toe end and a heel end and having a first side edge extending from the midline of said toe end to the midline of said heel end and a second side edge extending from the midline of said toe end to the midline of said heel end;

(b) a first body member having a lower edge securely attached relative to said first side edge of said sole member from a front attachment point to a rear attachment point, said rear attachment point of said first body member being on said first side edge of said sole member spaced from said midline of said heel end of said sole member, said first body member having a heel end portion for coacting with at least a portion of the wearer's heel with only a typical sock covering the wearer's heel and having a forefoot portion for coating with at least a portion of the wearer's forefoot with only a typical sock covering the wearer's forefoot;

(c) a second body member having a lower edge securely attached relative to said second side edge of said sole member from a front attachment point to a rear attachment point, said rear attachment point of said second body member being on said second side edge of said sole member spaced from said midline of said heel end of said sole member, said second body member having a heel end portion for coacting with at least a portion of the wearer's heel with only a typical sock covering the wearer's heel and having a forefoot portion for coacting with at least a portion of the wearer's forefoot with only a typical sock covering the wearer's forefoot;

(d) first attachment means for adjustably securing said heel end portions of said body members relative to one another and for allowing said shoe to be adjusted for different heel shape and size and for applying pressure to the wearer's heel; and (e) second attachment means for adjustably securing said forefoot portions of said body members relative to one another and for allowing said shoe to be adjusted for different midfoot, forefoot and toe shape and size and for applying pressure to the wearer's midfoot.

* * * * *